US008899682B2

(12) United States Patent
Nilsson et al.

(10) Patent No.: US 8,899,682 B2
(45) Date of Patent: Dec. 2, 2014

(54) ITEM OF FURNITURE

(75) Inventors: Robert Anders Nilsson, Montrose (AU); Wayne Davies, Springvale South (AU)

(73) Assignee: Smart Seating International Pty. Ltd., Melbourne (AU)

( * ) Notice: Subject to any disclaimer, the term of this patent is extended or adjusted under 35 U.S.C. 154(b) by 0 days.

(21) Appl. No.: 13/503,929

(22) PCT Filed: Oct. 27, 2010

(86) PCT No.: PCT/AU2010/001440

§ 371 (c)(1),
(2), (4) Date: Jun. 29, 2012

(87) PCT Pub. No.: WO2011/050413

PCT Pub. Date: May 5, 2011

(65) Prior Publication Data

US 2012/0256459 A1 Oct. 11, 2012

(30) Foreign Application Priority Data

Oct. 27, 2009 (AU) ..... 2009905240

(51) Int. Cl.
*A47C 1/00* (2006.01)
*A47C 3/18* (2006.01)
*A47C 1/023* (2006.01)

(52) U.S. Cl.
CPC .. *A47C 3/18* (2013.01); *A47C 1/023* (2013.01)
USPC ..... 297/344.24; 297/344.21

(58) Field of Classification Search
USPC ..... 297/344.21, 344.24
See application file for complete search history.

(56) References Cited

U.S. PATENT DOCUMENTS 3,113,804 A * 12/1963 Ritter ..... 297/252
3,718,365 A * 2/1973 Gibson ..... 297/344.24

(Continued)

FOREIGN PATENT DOCUMENTS

CA 2174787 10/1997

OTHER PUBLICATIONS

David, Daniel, "Notification of Transmittal of International Preliminary Report on Patentability (Chapter II of the Patent Cooperation Treaty)", International Application No. PCT/AU2010/001440, issued on Feb. 27, 2012 (8 pages).

(Continued)

*Primary Examiner* — Sarah B McPartlin
(74) *Attorney, Agent, or Firm* — Fish & Richardson P.C.

(57) ABSTRACT

There is disclosed a chair (10) for positioning an individual with respect to a reference location (5), such as a table. The chair (10) comprises a base portion (12) configured to be located on a support surface (6). A seat portion (16) is mounted to the base portion (12) and is configured to receive the individual thereon. A first mechanism (21) is configured to provide rotational movement of said seat portion (16) with respect to said base portion (12). A second mechanism (25) is configured to provide sliding lateral movement of the seat portion (16) with respect to said base portion (12). The first mechanism (21) and the second mechanism (25) are activated independently to facilitate movement of the individual from a first position that is located remote from the reference location (5) to a second position that is located adjacent said reference location (5) without the need for movement of the base portion (12) with respect to the support surface.

15 Claims, 10 Drawing Sheets

(56) References Cited

U.S. PATENT DOCUMENTS

| | | | | | |
|---|---|---|---|---|---|
| 4,091,479 | A | * | 5/1978 | Hancock | 4/560.1 |
| 4,168,549 | A | * | 9/1979 | Davies | 4/578.1 |
| 5,068,930 | A | * | 12/1991 | Ruggiero | 4/560.1 |
| 5,097,542 | A | * | 3/1992 | Roesler | 4/579 |
| 5,193,633 | A | * | 3/1993 | Ezenwa | 180/65.1 |
| 5,702,084 | A | | 12/1997 | Carnahan et al. | |
| 5,704,729 | A | | 1/1998 | Carnahan et al. | |
| 5,822,809 | A | * | 10/1998 | Gallo | 4/578.1 |
| 6,122,776 | A | * | 9/2000 | Cheng | 4/578.1 |
| 6,325,456 | B1 | | 12/2001 | Carnahan | |
| 7,661,154 | B2 | * | 2/2010 | Cheng | 4/560.1 |

OTHER PUBLICATIONS

David, Daniel, "International Search Report", International Application No. PCT/AU2010/001440, issued on Jan. 14, 2011 (5 pages).

* cited by examiner

ITEM OF FURNITURE

CROSS-REFERENCE TO RELATED APPLICATIONS

The present application claims priority from Australian Provisional Patent Application No. 2009905240 filed on 27 Oct. 2009, the contents of which are incorporated herein by reference.

FIELD OF INVENTION

This invention relates to an item of furniture to assist in the positioning of an individual seated thereon, with respect to a reference point. In particular, the present invention relates to a chair for use by an individual with reduced mobility that assists in positioning the individual close to a table or the like without the need to physically move the chair.

BACKGROUND ART

For many individuals with reduced mobility and/or limb co-ordination, the act of performing simple tasks that many able-bodied individuals take for granted, can provide significant challenges. Individuals, such as those suffering from a physical or neurological disability, the elderly and the like, typically require assistance to perform such tasks. Assistance may come in the form of aids or devices developed to artificially perform a function, such as wheelchairs and stair lifts, or may come in the form of human assistance such as a nursing aid or dedicated carer that assists the individual in performing selected tasks. The type of assistance preferred by an individual may depend upon the needs of the individual or the level of incapacity of that individual.

One such task that provides particular difficulty for many individuals such as the elderly and those suffering from a physical or neurological disability is the ability for the individual to correctly position themselves at a table. This may be for the purpose of eating at the table or merely being close enough to the edge of the table to use the table in a controlled manner. Such a difficulty is typically due to the fact that in order to correctly position oneself at a table requires a number of co-ordinated steps.

A first step in seating may be to withdraw the chair from the table such that there is sufficient space between the chair and the edge of the table to accommodate the person to enable them to sit on the chair. The next step is for the person to slide both themselves and the chair towards the table such that they are positioned at a comfortable distance from the edge of the table to enable them to access the table according to their needs. This step of sliding or shuffling a chair towards a table requires particular co-ordination as the person is required to move themselves and the chair together, which can be extremely difficult or impossible for those such as the elderly and/or disabled.

Further, in many care facilities such as nursing homes or elderly care units, dedicated staff are provided to assist individuals in performing such a task. This typically requires the staff to shift both the individual and the chair to position the individual at the table such that they can perform such functions as eating in a controlled manner. Such a task can be physically demanding, especially if the individual and the chair are considerably heavy and can be a significant cause of workplace injury.

As such, there is a need to provide a chair or the like that offers the ability for an individual to be positioned at a table and the like, without the need for considerable physical effort on behalf of the individual and/or the individual's carer or staff.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

Accordingly, in one aspect of the invention there is provided a chair for positioning an individual with respect to a reference location, comprising:

- a base portion configured to be located on a support surface;
- a seat portion, mounted to said base portion, and configured to receive said individual thereon;
- a first movement mechanism configured to provide rotational movement of said seat portion with respect to said base portion; and
- a second movement mechanism configured to provide sliding lateral movement of the seat portion with respect to said base portion;
- wherein the first movement mechanism and the second movement mechanism are activated independently to facilitate movement of the individual from a first position that is located remote from the reference location to a second position that is located at said reference location without the need for movement of the base portion.

In one embodiment, the base portion comprises one or more leg members connected to a frame. The seat portion may comprise a seat cushion supported on a seat frame and at least a backrest for supporting the individual thereon.

The second movement mechanism may comprise at least one first runner connected to the frame and at least one second runner connected to the seat frame adjacent to an underside of the seat cushion such that the first runner and the second runner co-operate to provide sliding movement of the seat portion with respect to the base portion. The first movement mechanism may be mounted to the seat frame adjacent to the underside of the seat cushion and the at least one second runner may be mounted to the first movement mechanism. The first movement mechanism may comprise a first plate in rotational engagement with a second plate. A locking means may be provided to control activation of the first and or second movement mechanism.

In a preferred embodiment the reference location is a table. When the chair is in the first position the individual may be located remote from the table and when the chair is in the second position the user may be located at the table.

In another embodiment, the first mechanism may be mounted on one or more slide members. The one or more slide members may cooperate with one or more corresponding slide members mounted on the base portion to form the second mechanism. In a preferred form, the one or more slide members may be received within the one or more corresponding slide members mounted on the base portion to form the second mechanism.

According to another aspect, there is provided a method for positioning an individual at a table comprising the steps of:

- positioning a chair adjacent the table such that one or more legs of the chair are fixedly located with respect to the table;

rotating a seat portion of said chair away from said table so as to receive the individual therein;

rotating the seat portion of the chair towards said table so as to position said individual for seating at the table; and sliding the seat portion of the chair towards said table such that the individual is located adjacent an edge of the table whilst the one or more legs remain fixedly located with respect to the table.

BRIEF DESCRIPTION OF THE DRAWINGS

The invention may be better understood from the following non-limiting description of preferred embodiments, in which.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The present invention will be described below in relation to its application for use as a chair in a dining situation, whereby an individual, such as an elderly person, is placed in the chair so as to be positioned at a table for dining. However, it will be appreciated that the chair of the present invention may take a variety of forms and may be used in a variety of situations where positioning of an individual with respect to a reference point is desired without requiring movement of the chair. Such modifications and alternative embodiments still fall within the spirit of the present invention.

Figure 1:
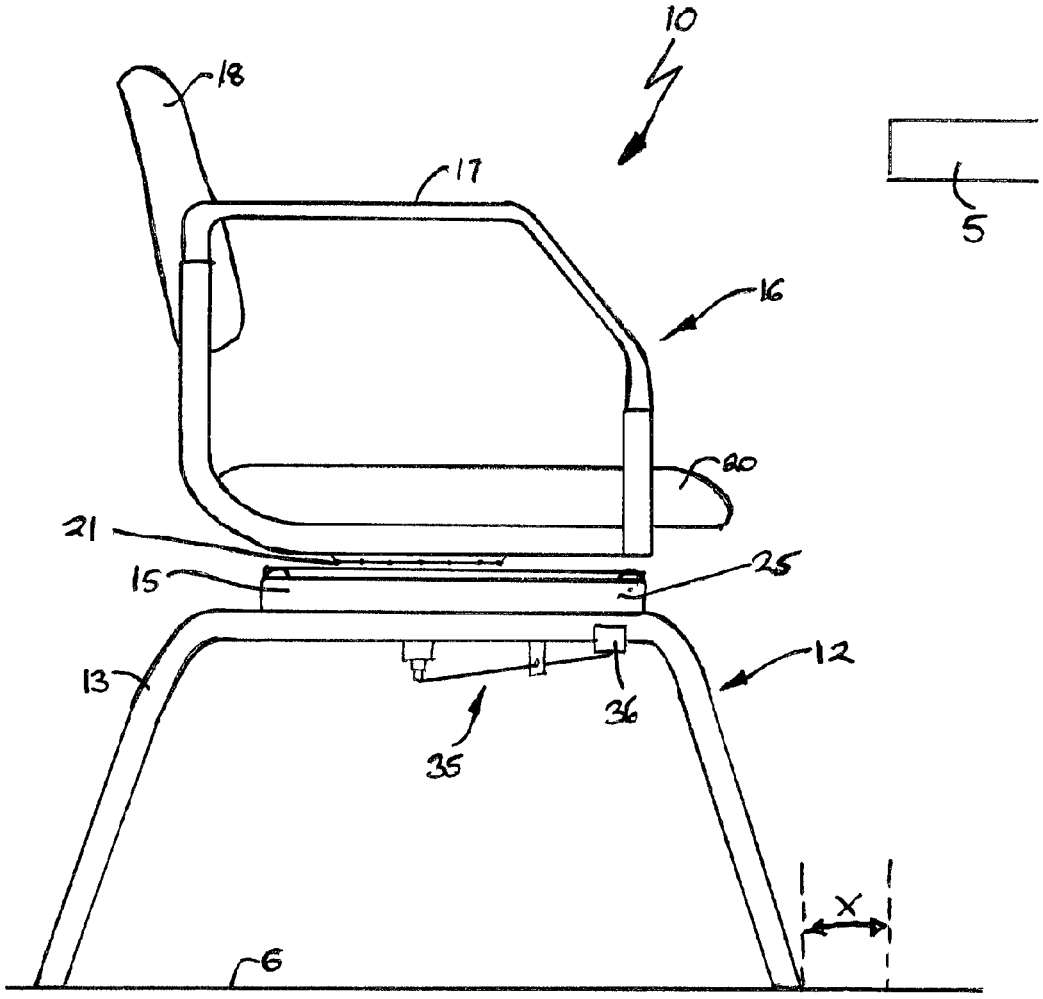
FIG. 1 is side view of a chair according to one embodiment of the present invention.

Referring to FIG. 1, a side view of a chair 10 in accordance with one embodiment of the present invention is shown. The chair 10 generally comprises a base portion 12 that is configured to be supported on a floor surface 6, and a seat portion 16 that is mounted on the base portion 12. The seat portion 16 is configured to receive the individual thereon.

Figure 4:
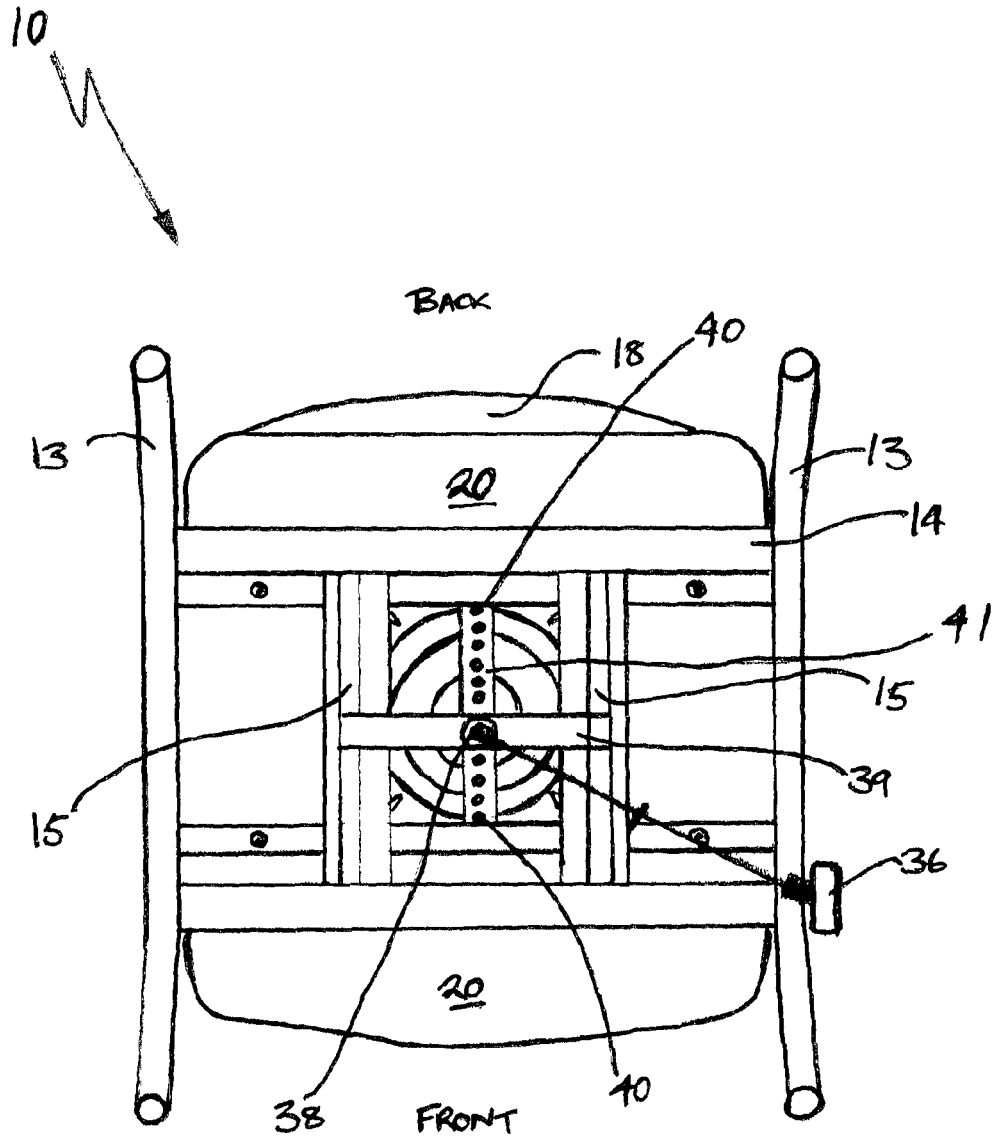
FIG. 4 is a bottom view of the chair of FIG. 1.

The base portion 12 comprises a pair of spaced apart leg members 13 having a frame 14 mounted to extend therebetween, as is shown more clearly in FIG. 4. The leg members 13 each extend from front to back along opposing sides of the frame 14 in a substantially parallel manner. However, it will be appreciated that the leg members 13 may alternatively cross over or may comprise four separate leg members that are each attached to the frame at four corners thereof, as will be appreciated by those skilled in the art. The purpose of the leg members 13 is to support the frame 14 in a stable manner above the floor surface 6 such that once positioned, the leg members 13 will not require movement to position the individual at the table 5. In this regard the leg members may include gripping or anti-slip devices on the ends thereof.

Figure 2:
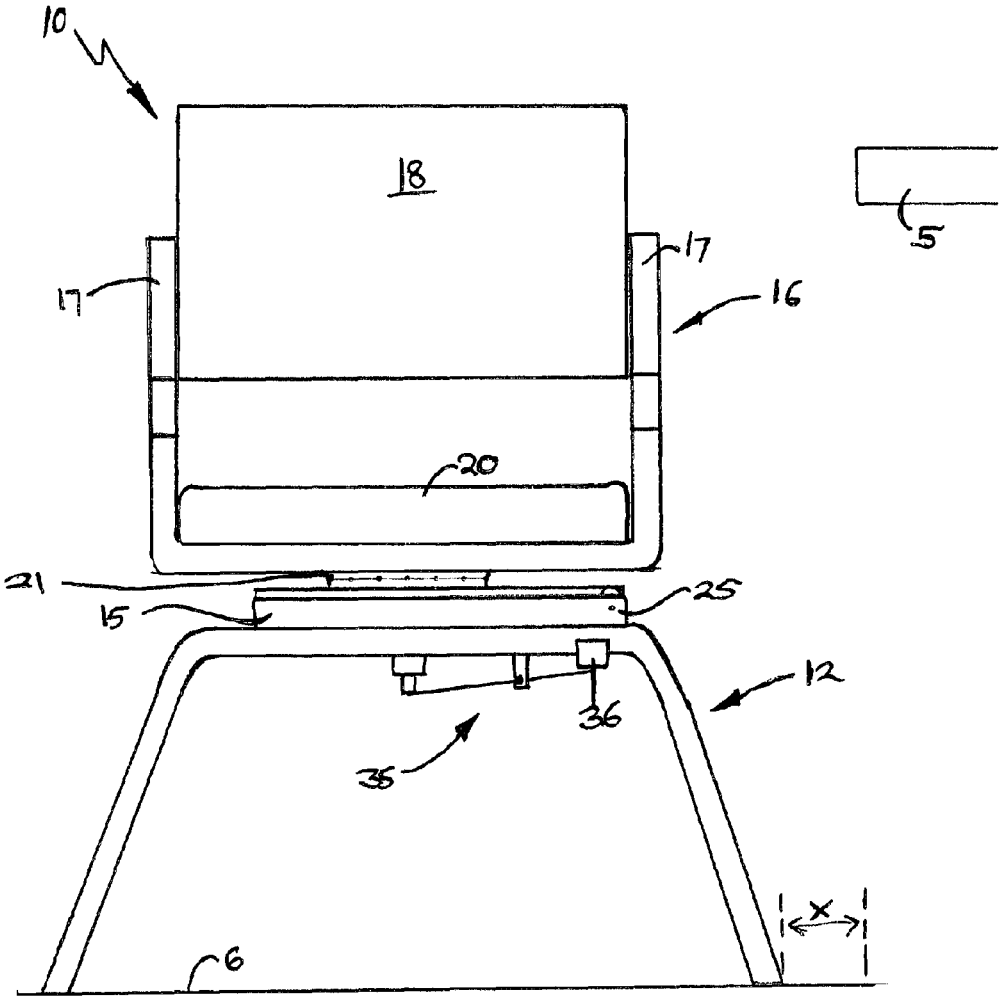
FIG. 2 is a side view of the chair of FIG. 1 with the seat portion in a rotated position.
Figure 3:
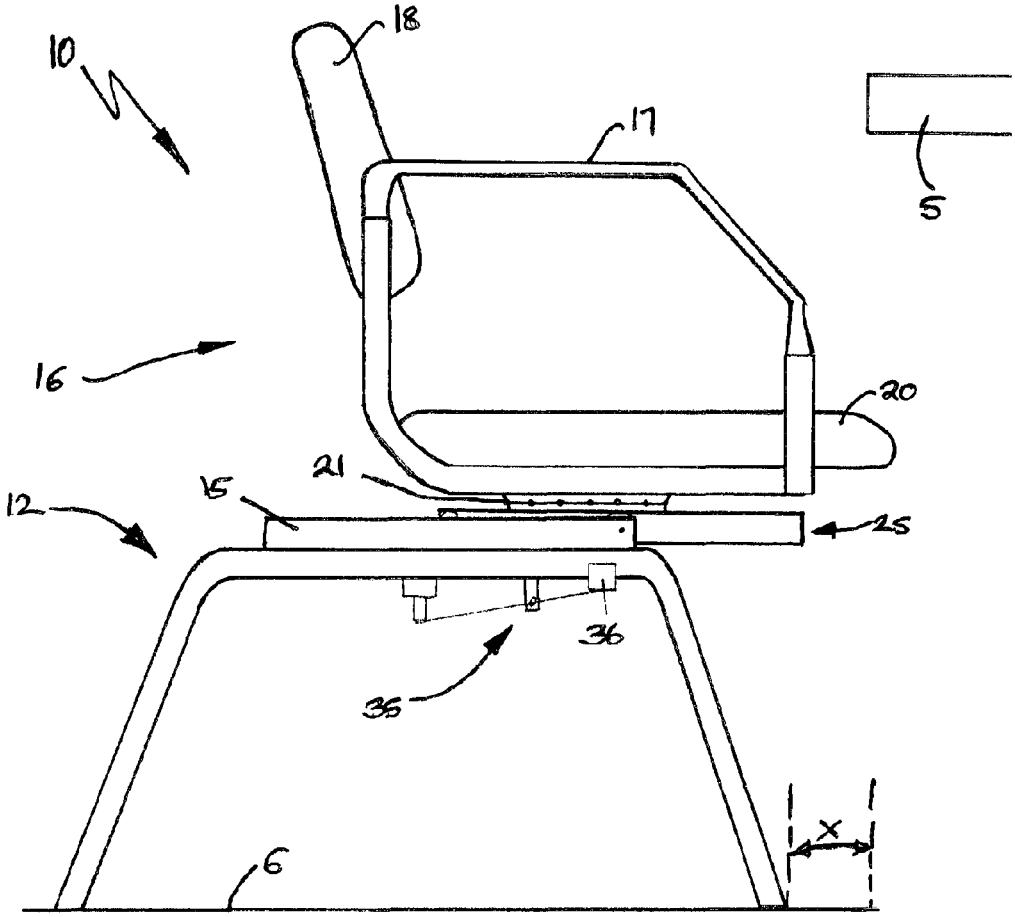
FIG. 3 is a side view of the chair of FIGS. 1 and 2 with the seat portion in the forward position.

Referring to FIGS. 1-3, runners 15 are mounted on opposing sides or the upper surface of the frame 14 as shown. The runners 15 are attached so as to extend substantially parallel with the leg members 13. As is shown more clearly in FIG. 5, the runners 15 are substantially identical in configuration and comprise an elongate, substantially L-shaped channel portion 15*a* with a roller 15*b* mounted on an inner surface thereof. The runners 15 are configured to receive corresponding runners 19 associated with the seat portion 16, in a manner to be discussed in more detail below.

The seat portion 16 generally comprises a seat cushion 20 supported on a seat frame, upon which a posterior of the user is received. A backrest 18 is also provided to support the users back when positioned on the seat cushion 20. A pair of armrests 17 extend along opposing sides of the seat cushion 20, connected to the seat frame, in the manner as shown, to support the user's arms as required. It will be appreciated that the configuration of the seat portion 16 and frame may vary in accordance with various design and aesthetic considerations and still fall within the spirit of the present invention.

The seat portion is mounted upon a first or swivel mechanism 21 as is shown in FIGS. 1-3. The swivel mechanism 21 is mounted to the frame adjacent to the underside of the seat cushion 20 and comprises a first plate 23 in rotational engagement with a second plate 24. As is shown in FIG. 6, the first plate 23 has a plurality of slots or recesses 23*a* formed therein to receive screws or similar attachment means to facilitate mounting of the seat portion 16 to the swivel mechanism 21. The second plate 24 is mounted to runners 19 in the manner as shown. The runners 19 are then received by the corresponding runners 15 mounted to the base portion 12 of the chair 10 in a conventional manner. The runners 19 are also in the form of an elongate channel portion with rollers 19*b* provided thereon such that when the runners 15, 19 are brought together as is clearly shown by the arrow in FIG. 5, the seat portion 16 can slidingly move with respect to the base portion 12, in a manner to be discussed in more detail below. The degree of travel of the seat portion 16 with respect to the base portion 12 may vary depending upon the application by altering the lengths of the runners 15, 19. In a preferred embodiment the maximum degree of travel may be 150 mm. Together, the runners 15, 19 provide a second or sliding mechanism 25 of the present invention. It will be appreciated that the first or swivel mechanism 21 is mounted to the base portion 12 of the seat 10 by way of the second or sliding mechanism 25.

Figure 5:
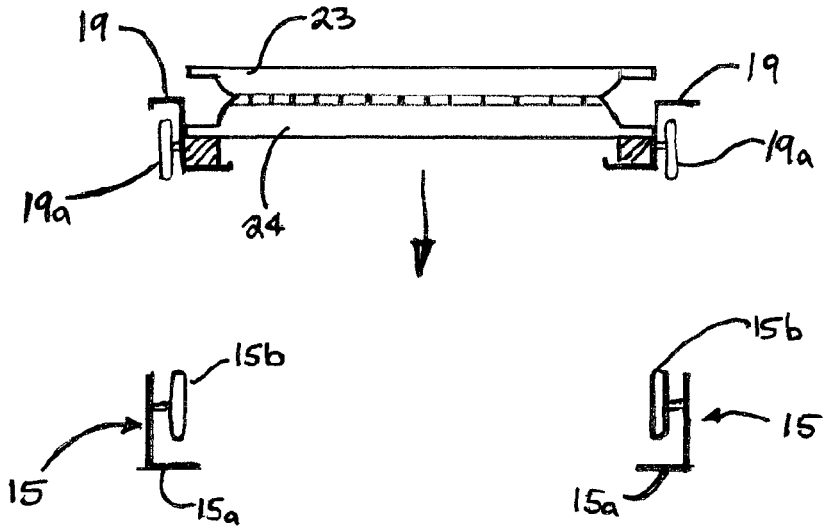
FIG. 5 is an end view of the sliding and swivel mechanisms of the chair of FIG. 1 in isolation.
Figure 6:
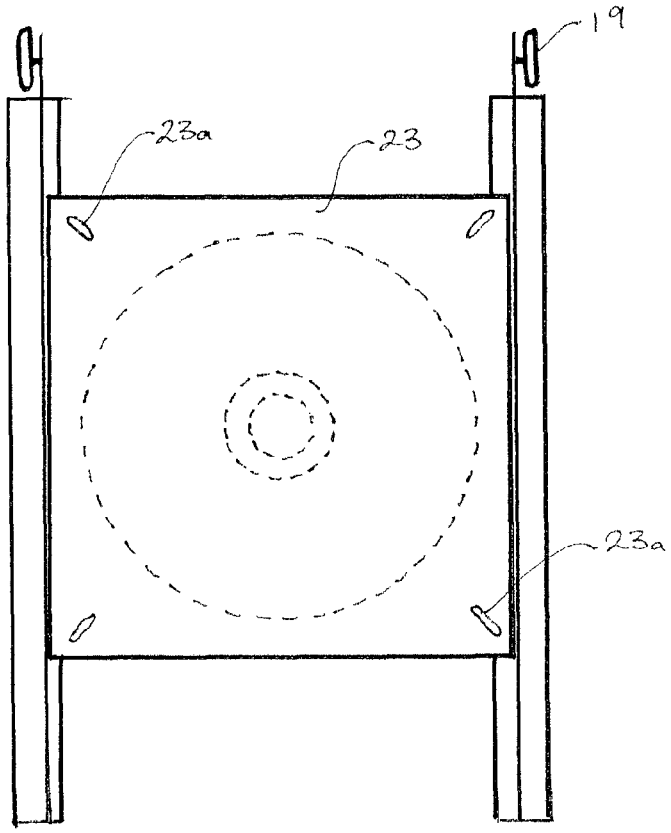
FIG. 6 is a top view of the sliding and swivel mechanisms of FIG. 5.

Referring to FIG. 5, the first and second plates 23, 24 are configured such that they can rotate with respect to each other about a central axis. The respective surfaces of the first and second plates 23, 24 that are in contact are configured to provide controlled swivel motion between the plates. In this regard, the surfaces are configured with grooved surfaces such that they mesh together to control the degree of rotational movement of the first plate 23 with respect to the second plate 24. As the second plate 24 is mounted to the base portion 12 of the chair 10, it is constrained from any rotational movement. Hence, any rotational movement applied by the user to the seat portion 16 will result in the seat portion 16 rotating with respect to the base portion 12. Limits may be provided to prevent the degree of rotational movement of the seat portion 16 with respect to the base portion 12, with movement of around 180-220° being desirable. Such a 180-220° arc of movement provides a user to access the chair from either a left or right hand side of the chair as desired. Further, such a degree of rotational movement of the seat portion 16 is sufficient to provide a suitable gap between the edge of the table 5 and the chair 10 to enable a user to be seated on the seat portion 16.

Figure 7:
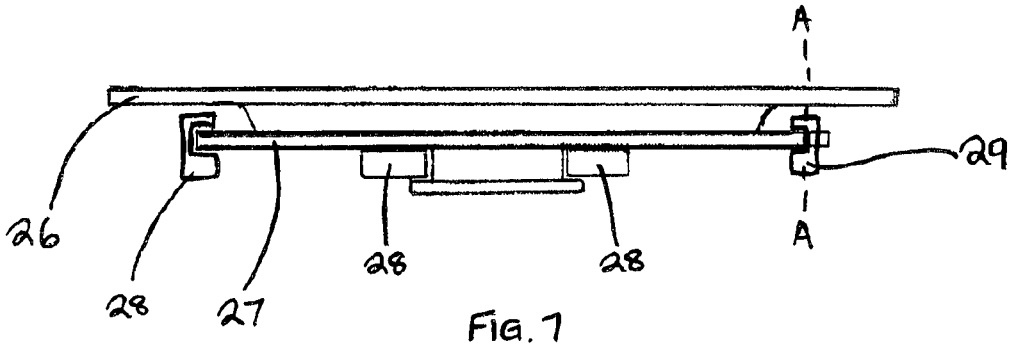
FIG. 7 is a side view of an alternative embodiment of a swivel mechanism for use with the present invention.
Figure 8:
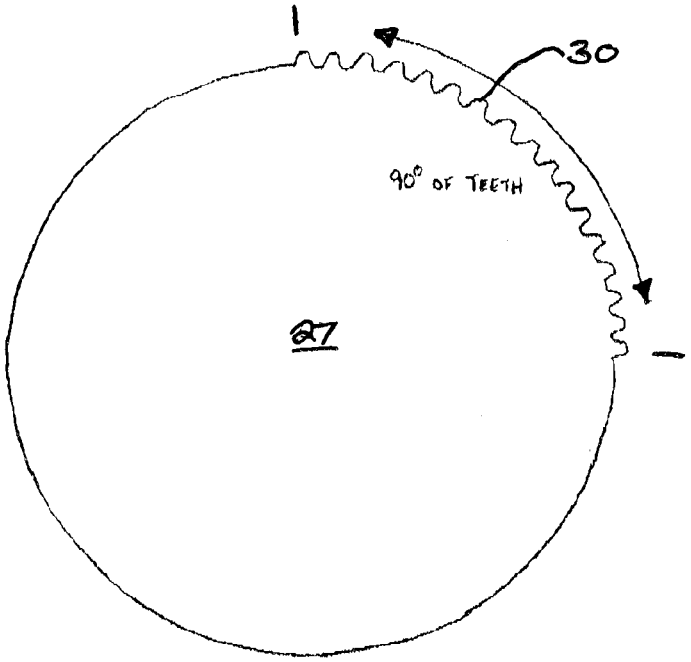
FIG. 8 is a top view of a sprocket plate for use with the swivel mechanism of FIG. 7.
Figure 9:
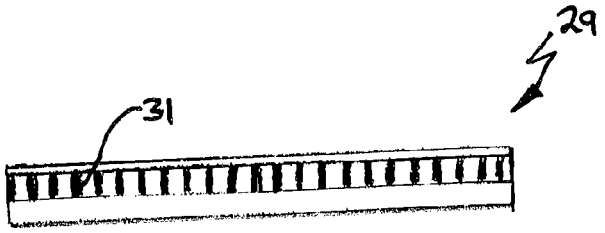
FIG. 9 is a cross-sectional view of a tooth guide of the swivel mechanism through plane A-A of FIG. 7.

It will be appreciated that the swivel mechanism 21 may take a variety of forms and still fall within the spirit of the present invention. One such alternative form is shown in FIGS. 7-9. In this embodiment, the swivel mechanism 21 comprises a mounting plate 26 to which the seat portion 16 of the seat is mounted. The mounting plate 26 has a sprocket plate 27 mounted to an underside thereof.

The sprocket plate 27 is shown in isolation in FIG. 8 and comprises a substantially circular plate with a plurality of teeth 30 formed at least partially about a perimeter thereof. In the embodiment as shown the teeth 30 extend along a 90° arc of the plate 27, and are formed with a substantially constant pitch.

A plurality of guides 28 and 29 are mounted adjacent an underside of the sprocket plate 27. The guides 28, 29 are provided to facilitate mounting of the mounting plate 26 and sprocket plate 27 to the sliding mechanism 25 of the base portion 12 of the seat. FIG. 9 shows a cross-sectional view of guide 29 through axis A-A of FIG. 7. In this arrangement, guide 29 acts to control the degree of rotation of the seat portion 16 with respect to the base portion 12 of the seat 10. The guide 29 has a series of grooves 31 provided along an inner surface thereof that mesh with the teeth 30 provided on the perimeter of the sprocket plate 27. In this arrangement, rotation of the seat portion 16 by the user caused the sprocket plate 27 and mounting plate 26 to rotate. Such rotational movement causes the teeth 30 to pass over the associated grooves 31 provided in guide 29 to provide limited rotational movement of the seat portion 16 of the seat. In this embodiment, the rotational movement of the seat portion is limited to 90°.

It will be appreciated that, the seat 10 of the present invention comprises a seat portion 16 mounted to a base portion 12 through a pair of independent movement mechanisms. The pair of independent movement mechanisms may be activated independently to provide rotational or swivel movement of the seat portion 16 with respect to the base portion 12, as well as lateral sliding movement of the seat portion 16 with respect to the base portion 12. This dual ability to move the seat portion with respect to the base portion enables a user to be seated in a pre-positioned seat and slide themselves forward into position at a table 5 in a simple action, without the need to slide the base portion of the chair towards the table. Further, in order to leave the table, the user is able to slide back and away from the table 5 and swivel away from the table 5 to stand, without the need for the position of the base of the chair to change.

Figure 10:
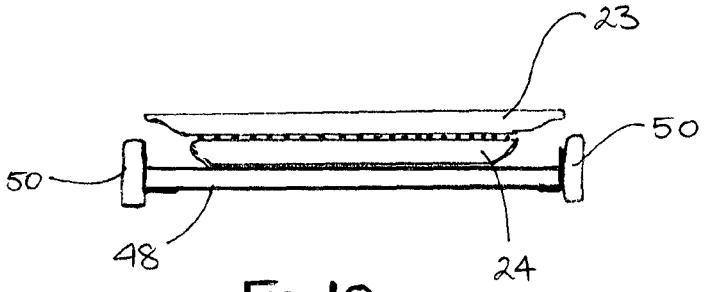
FIG. 10 is an end view of a swivel mechanism in accordance with an another embodiment of the present invention.
Figure 11:
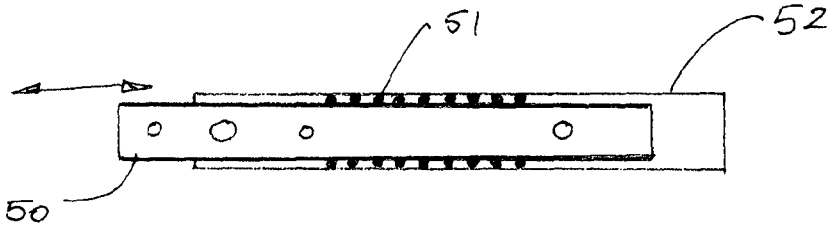
FIG. 11 is an alternative view of a sliding mechanism in accordance with another embodiment of the present invention.

As shown in FIGS. 10 and 11, an alternative embodiment of a slide mechanism 25 is shown. In this embodiment, the swivel mechanism, which comprises the first and second plates 23, 24 are also configured such that they can rotate with respect to each other about a central axis. The respective surfaces of the first and second plates 23, 24 that are in contact are configured to provide controlled swivel motion between the plates. The plates 23, 24 are mounted to a support bracket 48 which has an inner slide member 50 located along opposing sides of thereof.

As is shown in FIG. 11, the inner slide member 50 is configured to be received in an outer slide member 52 and is free to slide therein on bearings 51 or the like. As the inner slide member 50 is attached to the seat portion 20 of the seat and the outer slide member 52 is attached to the base portion of the seat, the seat portion 20 is able to slide with respect to the base portion in the direction of the arrow, as shown.

The manner in which the seat portion of the seat is able to move in relation to the base of the seat is shown in relation to FIGS. 1-3.

Referring to FIG. 1, the chair 10 is typically positioned adjacent an edge of the table 5 at a predetermined distance. The predetermined distance is shown as distance 'X' which is measured as the distance from the front leg of the chair to the edge of the table at which the user is to be seated. It will be appreciated that in one embodiment of the present invention, the chair 10 may be one of a number of dining chairs provided in a dining room of an elderly care facility or hospice, with the position of the chair(s) 10 being fixed with respect to the table 5.

As a first step, in order to sit on the chair, a user (or care provider) firstly swivels the seat portion 16 of the chair 10 approximately 90°, to the position as shown in FIG. 2. The base portion 12 remains stationary and the user is able to sit on the seat cushion 20 in a traditional manner.

As a second step, once seated, the user (or the user's care provider) is able to rotate or swivel the chair back into the original position as shown in FIG. 1. In this position the distance from the seated user to the table is typically too great for the user to access the table comfortably, especially to perform such tasks as eating and the like. Traditionally, the user (or care provider) has had to shuffle the chair forward towards the table in order to be positioned at a comfortable distance from the table to eat or the like. This can be a difficult task as both the weight of the chair and the user typically requires movement or shuffling and in instances where the chair is fitted with anti-slide devices such as stoppers and the like, the chair needs to be physically shifted with significant effort across the floor surface to move. Such a task is typically beyond the physical capabilities of many individuals, especially the elderly or disabled.

As a third step, as is shown in FIG. 3, in order for the user to position themselves at the table 5, the seat portion 16 slides forward on the base portion 12 a desired distance under the action of the user (or the user's care provider). This overcomes the need to deal with large loads and to lift the chair, thereby significantly reducing hazards associated with lifting and other health and safety issues, as well as providing a user with the independence to perform the task themselves.

In order to activate and deactivate the sliding mechanism 25, a locking mechanism 35 is provided. The locking mechanism 35 comprises a handle 36 that is conveniently located at the side of the chair 10, as shown in FIGS. 1-4, in a position that can be readily accessed by the user or their care provider. The handle 36 is connected to a locking pin 38 by way of a connecting rod 37. Referring to FIG. 4, the locking pin 38 is mounted on a cross-bar member 39 which is, in turn, mounted to the frame 14 of base portion 12. The locking pin 38 extends through the cross-bar member 39 to be received in a hole 40 provided in a locating member 41 secured to the second plate 24 of the swivel mechanism 21. As the locating member 41 moves with the seat portion 16, when the locking pin is located within one of the holes 40 of the locating member 41, the seat portion 16 is locked in position. Upon lifting the handle 36, the locking pin 38 is retracted from the cross-bar member 39 thereby disengaging the locating member 41 from contact with the seat portion 16. This enables the seat portion 16 of the seat 10 to slide with respect to the base portion 12. By releasing the handle 36, the locking pin 38, under the action of a biasing force such as a spring, projects back through the cross-bar member 39 to be received in a corresponding hole 40 of the locating member 41 thereby locking the seat portion 16 in the forward position as shown.

Figure 12:
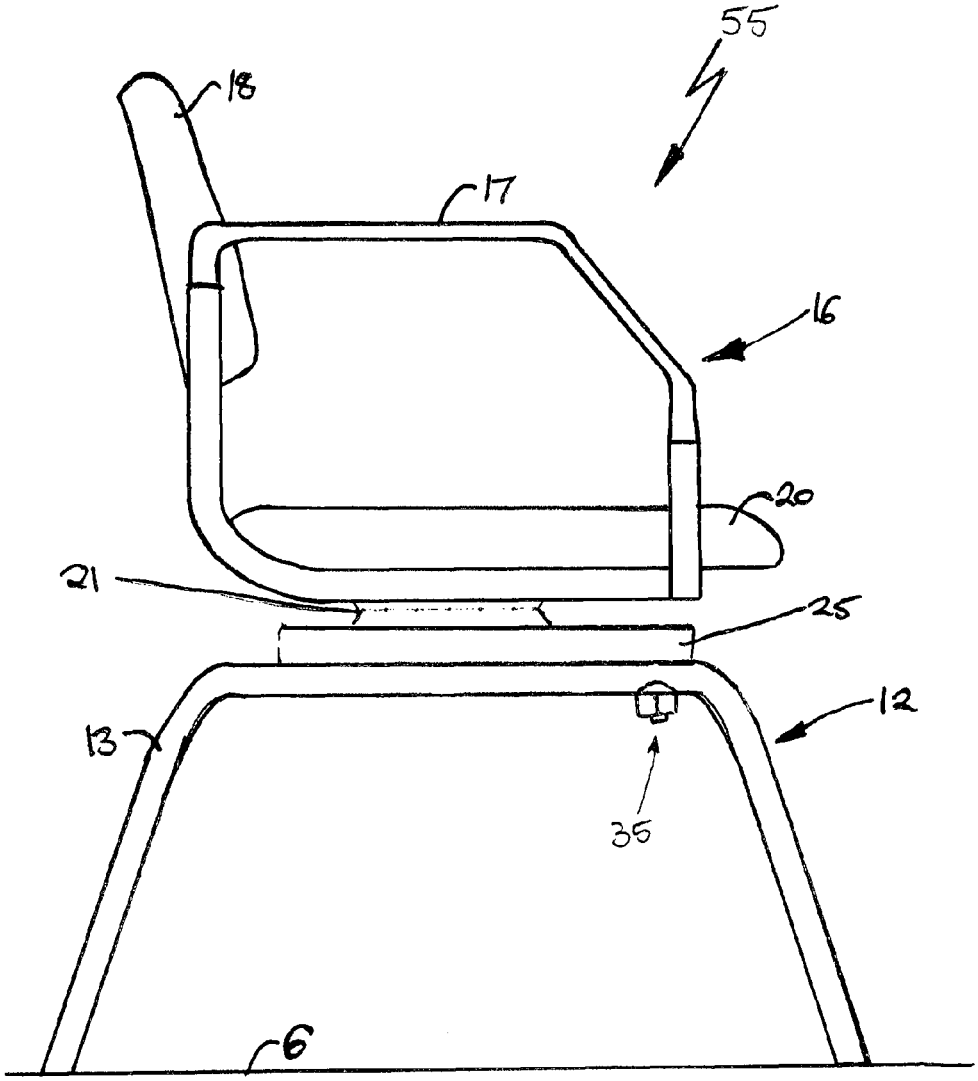
FIG. 12 is a side view of a chair having employing the swivel and sliding mechanisms of FIGS. 10 and 11.
Figure 13:
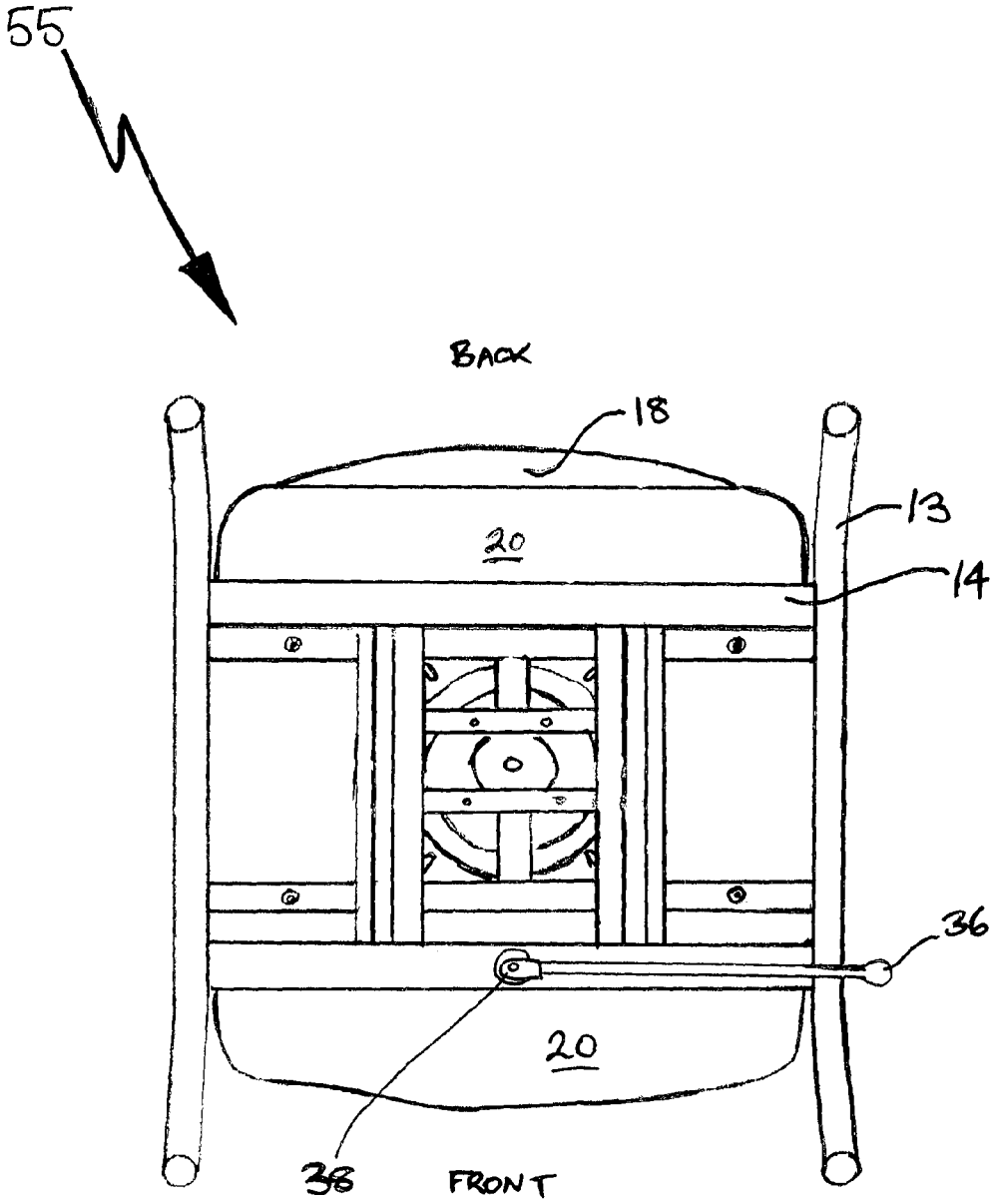
FIG. 13 is a bottom view of the chair of FIG. 12.
Figure 14:
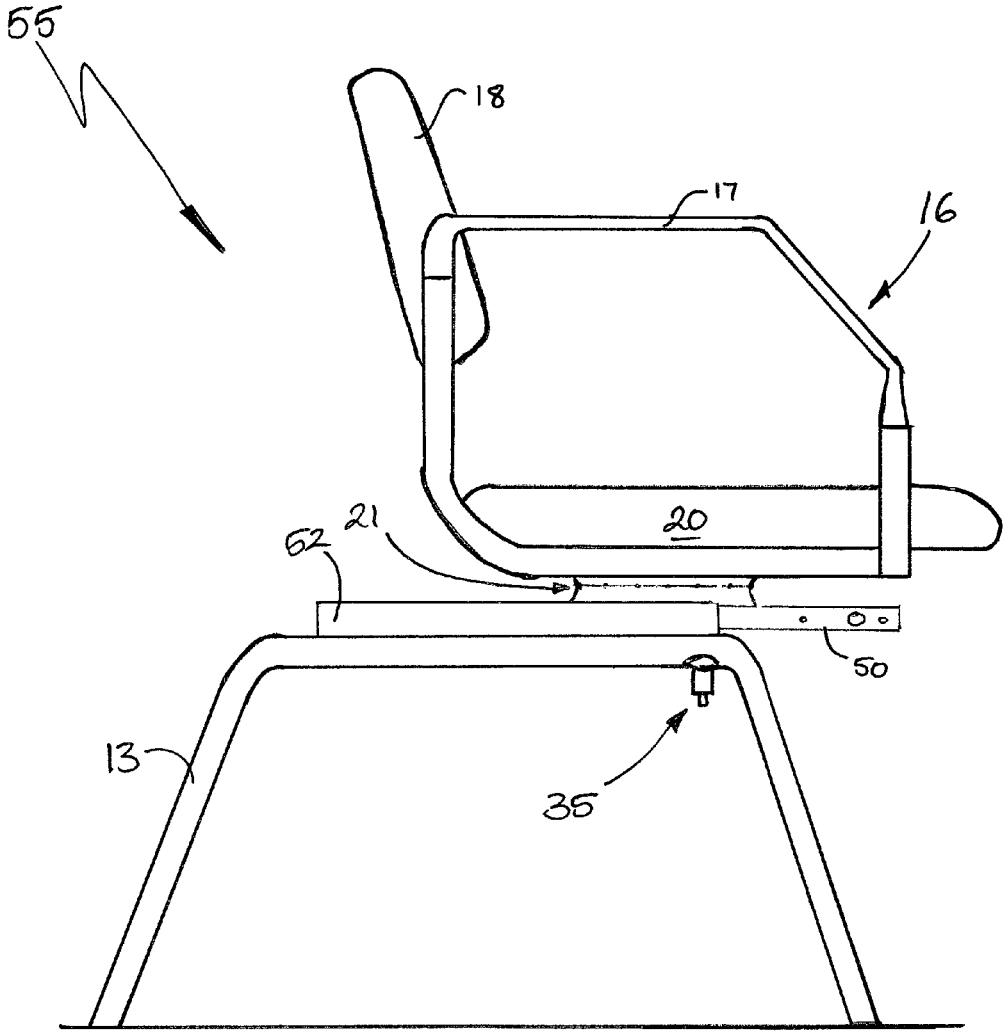
FIG. 14 is a side view of the chair of FIG. 12 with the seat portion in a forward position.

In FIGS. 12-14, an alternative embodiment of the present invention is shown employing the sliding mechanism 25 described and shown in relation to FIGS. 10 and 11. As can be seen, when the seat 55 is moved from the normal position of FIG. 12 to the forward position of FIG. 14, the inner slide member 50 slides out of the outer slide member 52. As is shown in FIG. 13, the locking mechanism 35 acts to lock the seat 55 in position in a similar manner as described above.

It will be appreciated that the locking mechanism may take a variety of forms and still fall within the spirit of the present invention. Further, the locking mechanism may also incorporate a means for engaging/disengaging the swivel mechanism 21, as will be appreciated by those skilled in the art.

The present invention provides an item of furniture that can be used by individuals or by hospitals and care facilities that offers a simple and effective means for the elderly or those with reduced mobility or limb function and control, to perform simple tasks such as positioning themselves at a table to eat or use the table effectively. The invention can be used in situations where trained care providers can readily assist individuals to be seated at a table without requiring undue physical exertion that may cause injury to such workers. By providing a safe and user friendly environment the quality of life of the individual can be enhanced.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the seat uppermost.

It will be appreciated by those skilled in the art that many modifications and variations may be made to the methods of the invention described herein without departing from the spirit and scope of the invention.

The claims defining the invention are as follows:

1. A chair for positioning an individual with respect to a reference location, comprising:

a base portion having one or more leg members connected to a frame, wherein the one or more leg members are angled outwardly from the frame to contact the support surface at at least four locations, the one or more leg members being configured to be movably located on a support surface;

a seat portion, mounted to said base portion, and configured to receive said individual thereon;

a first mechanism configured to provide rotational movement of said seat portion with respect to said base portion;

a second mechanism configured to provide sliding lateral movement of the seat portion with respect to said base portion, the second mechanism movable between a retracted position and an extended position in which the seat portion extends beyond the frame in a direction of the lateral movement and beyond an area bounded by the four locations in a direction of the lateral movement;

a locking mechanism releasably engaged to the base and the second mechanism;

wherein the first mechanism and the second mechanism are each activated independently of a state of activation of the other, to facilitate movement of the individual from a first position that is located remote from the reference location to a second position that is located adjacent said reference location without the need for movement of the base portion with respect to the support surface; and wherein the locking mechanism is operable to fix the seat portion in multiple seating positions with respect to said base portion between said first position and said second position.

2. A chair according to claim 1, wherein the seat portion comprises a seat cushion and at least a backrest for supporting the individual thereon.

3. A chair according to claim 2, wherein the second mechanism comprises at least one first runner connected to said frame and at least one second runner connected to said seat cushion such that the first runner and the second runner cooperate to provide sliding movement of the seat portion with respect to the base portion.

4. A chair according to claim 3, wherein the first mechanism is mounted to the seat cushion and the at least one second runner is mounted to the first mechanism.

5. A chair according to claim 4, wherein the first mechanism comprises a first plate in rotational engagement with a second plate.

6. A chair according to claim 1, wherein the locking mechanism is releasably engaged to the first mechanism.

7. A chair according to claim 1, wherein the reference location is an edge of a table.

8. A chair according to claim 7, wherein when the chair is in the first position the individual is located remote from the table and when the chair is in the second position the user is located at the table.

9. A chair according to claim 1, wherein the first mechanism is mounted on one or more slide members.

10. A chair according to claim 9, wherein the one or more slide members cooperate with one or more corresponding slide members mounted on the base portion to form the second mechanism.

11. A chair according to claim 10, wherein the one or more slide members are received within the one or more corresponding slide members mounted on the base portion to form the second mechanism.

12. A chair according to claim 1, wherein the first mechanism enables rotational movement in an arc of movement between 180 and 220 degrees centered along the direction of lateral movement.

13. A chair according to claim 12, wherein the second mechanism comprises first runners engaged with second runners, the second mechanism movable between a retracted position and an extended position wherein overlap between the first runners and the second runners is more in the retracted position than in the extended position.

14. A chair according to claim 1, wherein the one or more leg members comprise two leg members, each of the two leg members configured to contact the support surface at two locations.

15. A chair according to claim 1, wherein the one or more leg members comprise four leg members.

* * * * *